US005860643A

United States Patent [19]

Moser et al.

[11] Patent Number: 5,860,643

[45] Date of Patent: Jan. 19, 1999

[54] COLLECTOR APPARATUS AND METHOD

[75] Inventors: James R. Moser, Easton; James N. Driscoll, Perkasie; Edward M. Otto, Bethlehem; David M. Skvoretz, Northampton, all of Pa.

[73] Assignee: Bell & Howell Mail Processing Systems, Durham, N.C.

[21] Appl. No.: 753,321

[22] Filed: Nov. 22, 1996

[51] Int. Cl.[6] ..... B65H 39/02

[52] U.S. Cl. ..... 270/58.07

[58] Field of Search ..... 270/58.07, 58.17, 270/58.27

[56] References Cited

U.S. PATENT DOCUMENTS

| | | | |
|---|---|---|---|
| 4,295,642 | 10/1981 | Kelly | 270/58.07 |
| 4,795,143 | 1/1989 | Tsai | 270/58.07 X |
| 5,421,662 | 6/1995 | Magee | 270/58.07 X |

*Primary Examiner*—Hoang Nguyen
*Attorney, Agent, or Firm*—Richard E. Jenkins, P.A.

[57] ABSTRACT

A high-capacity collector apparatus and method are provided for collecting sheet articles and advancing collected sheet articles. The collector apparatus includes a stage for collecting a stack of sheet articles advanced thereto wherein the stage is adjustable to accommodate sheet articles of various dimensions or sizes. Pusher/stop members are provided and are operable to stop sheet articles collected in a stack in the stage and to subsequently push the stack of sheet articles from the stage. The pusher/stop members are preferably lug members fixedly attached to a plurality of belts with each belt having one lug member fixedly attached thereto.

In a preferred embodiment, the collector apparatus comprises two pairs of independently controlled movable belts each having one lug member attached thereto. The lug members of one pair of belts are adapted for providing a front stop for one stack of sheet articles collected in the stage, and for alternately moving to a rear ready position and then pushing another stack of collected sheet articles from the stage at a predetermined time. Each belt operatively extends around one drive pulley and one idle pulley, and the belts are aligned so that two opposing shafts rotated independently by separate drive motors can be used to controllably drive each pair of belt means independently.

20 Claims, 11 Drawing Sheets

COLLECTOR APPARATUS AND METHOD

TECHNICAL FIELD

The present invention relates generally to a collector apparatus and method for collecting and advancing sheet articles. More particularly, the present invention relates to an improved high-capacity collector apparatus and method with an ability for the collection and subsequent advancement of large stacks of collected sheet articles of various dimensions and having particular application for use in high-speed media processing.

BACKGROUND ART

Various collector or accumulator apparatuses have been and/or are utilized for the collection and subsequent advancement of sheet articles comprising paper sheets, documents and the like such as those typically utilized in high-speed media processing such as, for example, mail processing.

One such collector apparatus and method utilizes a front stop/pusher carriage for advancing a set or stack of collected sheet articles into constant running nip rollers which handle and further advance the collected sheet articles. Another collector or accumulator apparatus and method that has been used in the past uses over and under continuously running round belt drives to advance sheet articles into clutch-actuated nip rollers. Yet another common collector apparatus and method uses flat belt drives and solenoid-actuated drop rollers to convey collected sheet articles into constant running nip rollers. These apparatuses and methods all suffer from the disadvantage of shingling of the set of collected sheet articles which can occur because of the nip rollers as well as from the problem of toner sometimes being transferred from the nip rollers to the processed material.

A collector apparatus and method used in the past which does not require the use of nip rollers is a Vacuum Sheet Sequencer device comprising a two belt system wherein each belt has two spaced-apart lugs fixedly attached thereto and the system is driven by a clutch brake system. One lug of each belt simultaneously acts as a front stop for collected sheet articles. Advancement of the collected sheet articles occurs by each belt simultaneously cycling such that the lugs acting as front stops move forward in the advance direction and out of the way of further advancement of the collected sheet articles by movement dictated by the belts. Since each belt has two lugs attached thereto, the other lugs of each belt simultaneously move to push the collected sheet articles from their previous stop position and stop in a position for providing a stop for subsequent collected sheet articles. Since the lugs are fixedly attached to the belts and therefore all cycle simultaneously, this system typically is adapted for collecting and advancing sheet articles of a certain predetermined dimension or size and therefore suffers from such disadvantage.

Another problem with prior art collector apparatuses and methods such as those described hereinabove is that they have a limited capacity regarding the number of stacked sheet articles that can be collected thereon and subsequently advanced therefrom. Typical prior art collector apparatuses and methods have at best a limited capacity or ability regarding the number of sheet articles that can be collected and advanced as a stack as such prior art apparatuses at best typically can only collect and advance a stack of up to approximately twenty-one (21) sheet articles. To compensate for such a limitation, large sets or stacks of sheet articles have had to be broken up into various subsets for processing.

In view of the problems associated with prior art collector apparatuses and methods, it can therefore be seen that much room for improvement exists in the art of collector apparatuses and methods for an improved collector apparatus and method with an ability to collect and advance large stacks of sheet articles of various dimensions or sizes in an improved manner.

DISCLOSURE OF THE INVENTION

In accordance with the present invention, a novel collector apparatus and method are provided for collecting sheet articles and subsequently advancing the collected sheet articles. The collector apparatus comprises a stage for collecting a stack of sheet articles advanced thereto wherein the stage is adjustable to accommodate sheet articles of various dimensions or sizes. Pusher/stop means are provided and are operable to stop sheet articles collected in a stack in the stage and to subsequently push the stack of sheet articles from the stage. The pusher/stop means comprises a plurality of belt means each having one lug member fixedly attached thereto.

In a preferred embodiment, the collector apparatus comprises two pairs of independently controlled movable belt means each having one lug member attached thereto. According to the method of this invention, the lug members of one pair of belt means are adapted for providing a front stop for one stack of sheet articles collected in the stage, and for alternately moving to a rear ready position and then pushing another stack of collected sheet articles from the stage at a predetermined time. Each belt means operatively extends around one drive pulley and one idle pulley, and the belt means are aligned so that two opposing shafts rotated independently by separate drive motors can be used to controllably drive each pair of belt means independently.

It is therefore an object of the present invention to provide a novel collector apparatus and method, particularly for use in high-speed media processing, for collecting and advancing sheet articles.

It is another object of the present invention to provide a collector apparatus and method for collecting and advancing sheet articles with an ability to collect and advance larger stacks of sheet articles than prior art collector apparatuses and methods.

It is a further object of the present invention to provide a collector apparatus and method which selectively and adjustably allows for collection and advancement of sheet articles of various dimensions or sizes.

It is still a further object of the present invention to provide a collector apparatus and method for improved handling of processed sheet articles in order to minimize toner smearing on and prevent shingling of processed sheet articles.

Some of the objects of the invention having been stated hereinabove, other objects will become evident as the description proceeds, when taken in connection with the accompanying drawings as best described hereinbelow.

BEST MODE FOR CARRYING OUT THE INVENTION

In accordance with the present invention, a novel collector apparatus generally designated 10 and method are provided which have particular use in high-speed media processing for collecting one or more sheet articles and advancing them from their collected position in an advance direction to another location. While it is envisioned in accordance with this invention that collector apparatus 10 can have other suitable applications, collector apparatus 10 is particularly adapted for collecting in a stack sheet articles fed in a seriatim and one-up manner in high-speed media processing and advancing the stack of collected sheet articles from collecting apparatus 10. The sheet articles can comprise any sheet articles suitable for processing such as in mail processing where the sheet articles can be paper sheets, documents, panels or the like. Collecting apparatus 10, however, has primary application for collecting and advancing flat unfolded sheet articles that can be over-accumulated. In a preferred embodiment, collecting apparatus 10 is modular in design so as to be easily operatively connected with and disconnected from other components for material processing.

Figure 1:
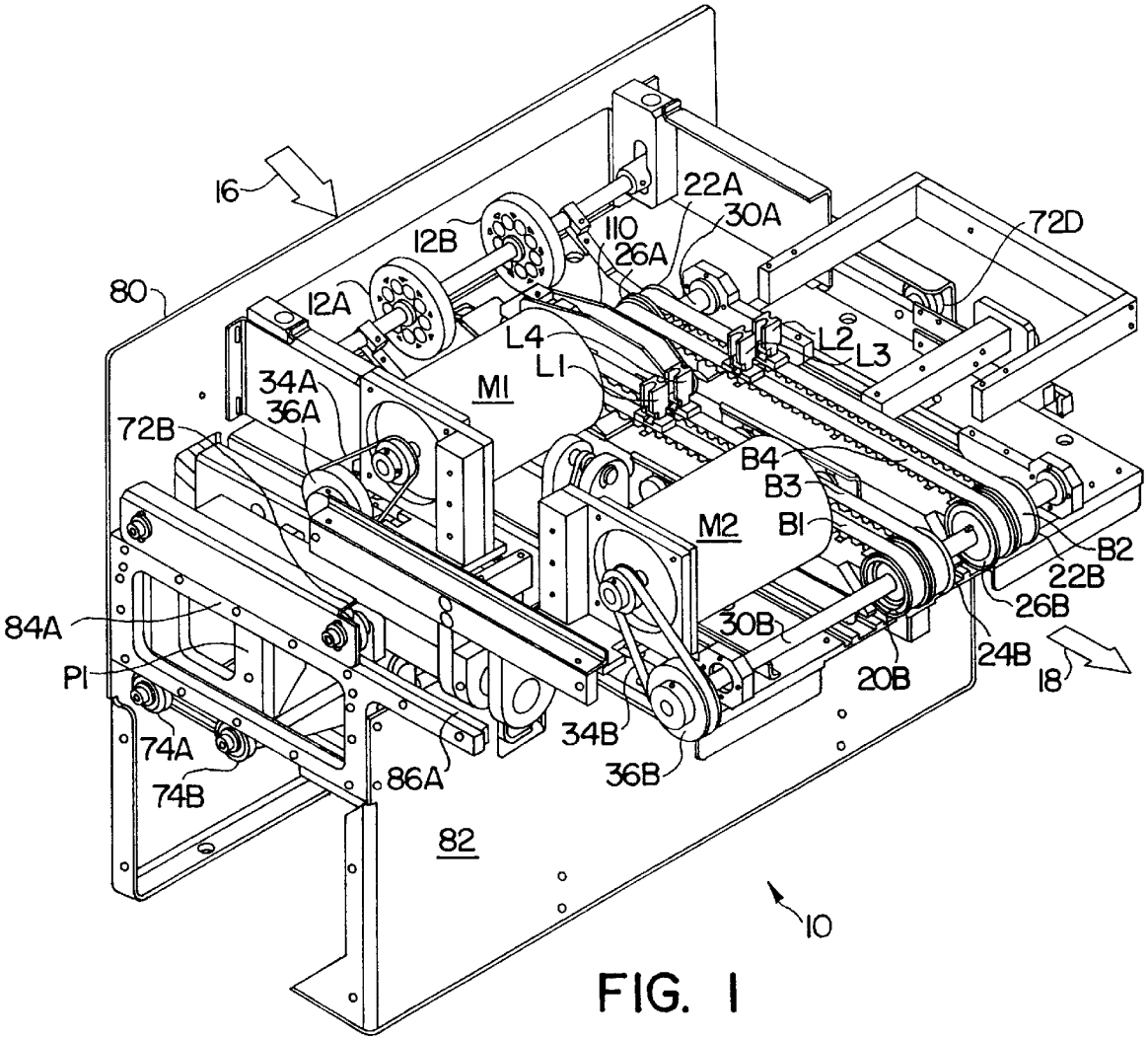
FIG. 1 of the drawings is a perspective view of a preferred embodiment of the collector apparatus of the present invention.

Referring to FIG. 1 of the drawings, a preferred embodiment of collector apparatus 10 is illustrated which is adapted for collecting and advancing one or more sheet articles. Typically, collecting apparatus 10 will be used to collect in a stack a plurality of sheet articles coming from another material processing device or unit and subsequently advance the stack of collected sheet articles. Sheet articles can be advanced in a seriatim and one-up manner to collecting apparatus 10 between upper entry idle transport rollers 12A and 12B and lower entry drive transport rollers 14A and 14B (FIG. 5), respectively, in the direction indicated by arrow 16. After collection of the sheet articles in a stack in collecting apparatus 10, the stack of collected sheet articles is advanced therefrom from the opposite side of collecting apparatus 10 in the direction indicated by arrow 18.

Figure 6:
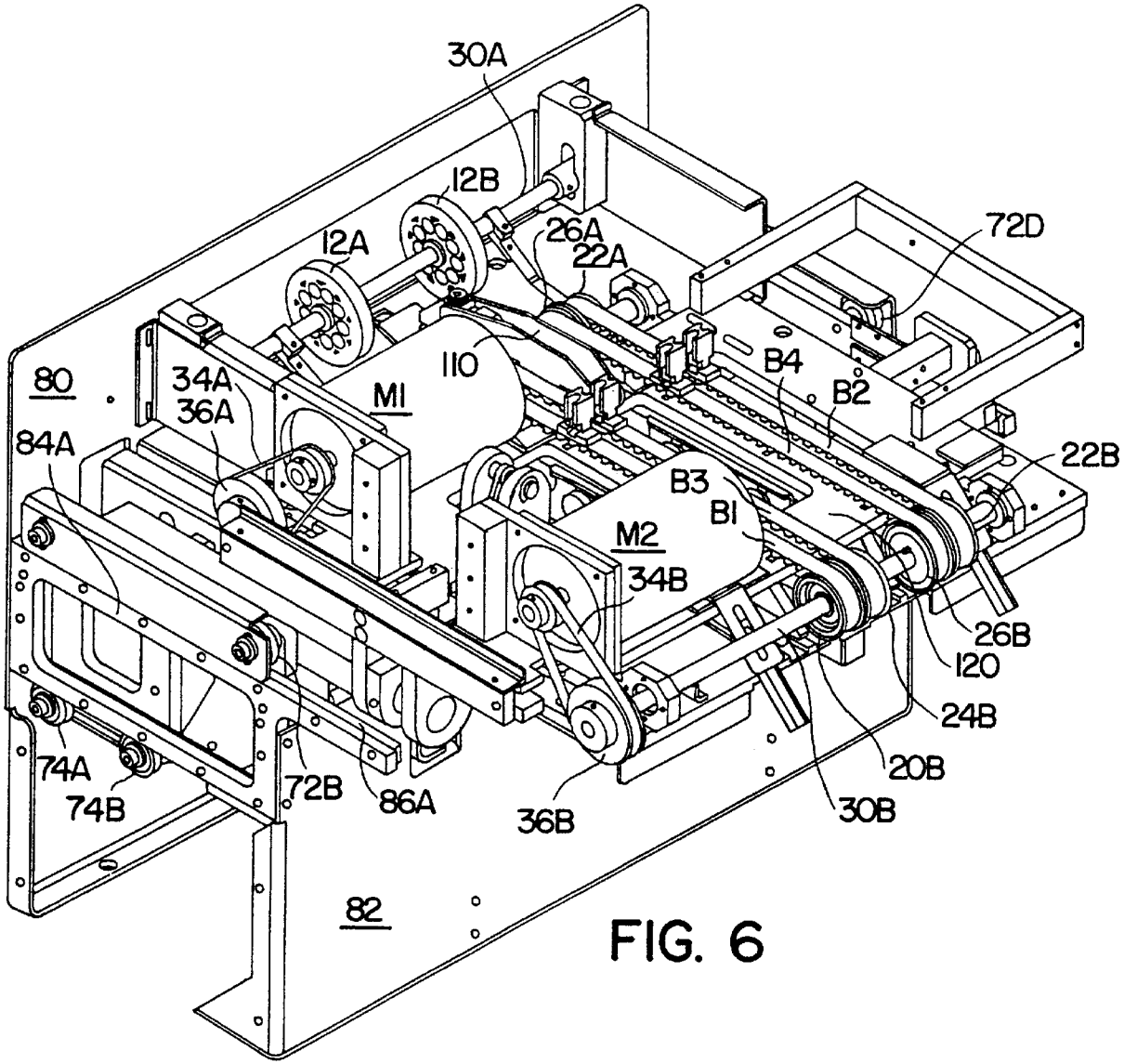
FIG. 6 of the drawings is a perspective view of the collector apparatus shown in FIG. 1 with an intermediate plate positioned between opposing upper and lower sides of the belt means and having deflector brushes extending therefrom.

Collector apparatus 10 comprises a plurality of spaced-apart and parallel belt means as illustrated in FIGS. 1, 6, 8A and 8B in a preferred embodiment. Although it is envisioned that the belt means could comprise other suitable structure such as, for example, suitable chain structures, the belt means preferably comprise a first outer pair of endless timing belts B1 and B2 and a second inner pair of endless timing belts B3 and B4. As illustrated in FIGS. 1 and 6, belts B1, B2, B3 and B4 each extend around and between a pair of opposing pulleys 20A and 20B, 22A and 22B, 24A and 24B and 26A and 26B, respectively.

Figures 2A, 2B:
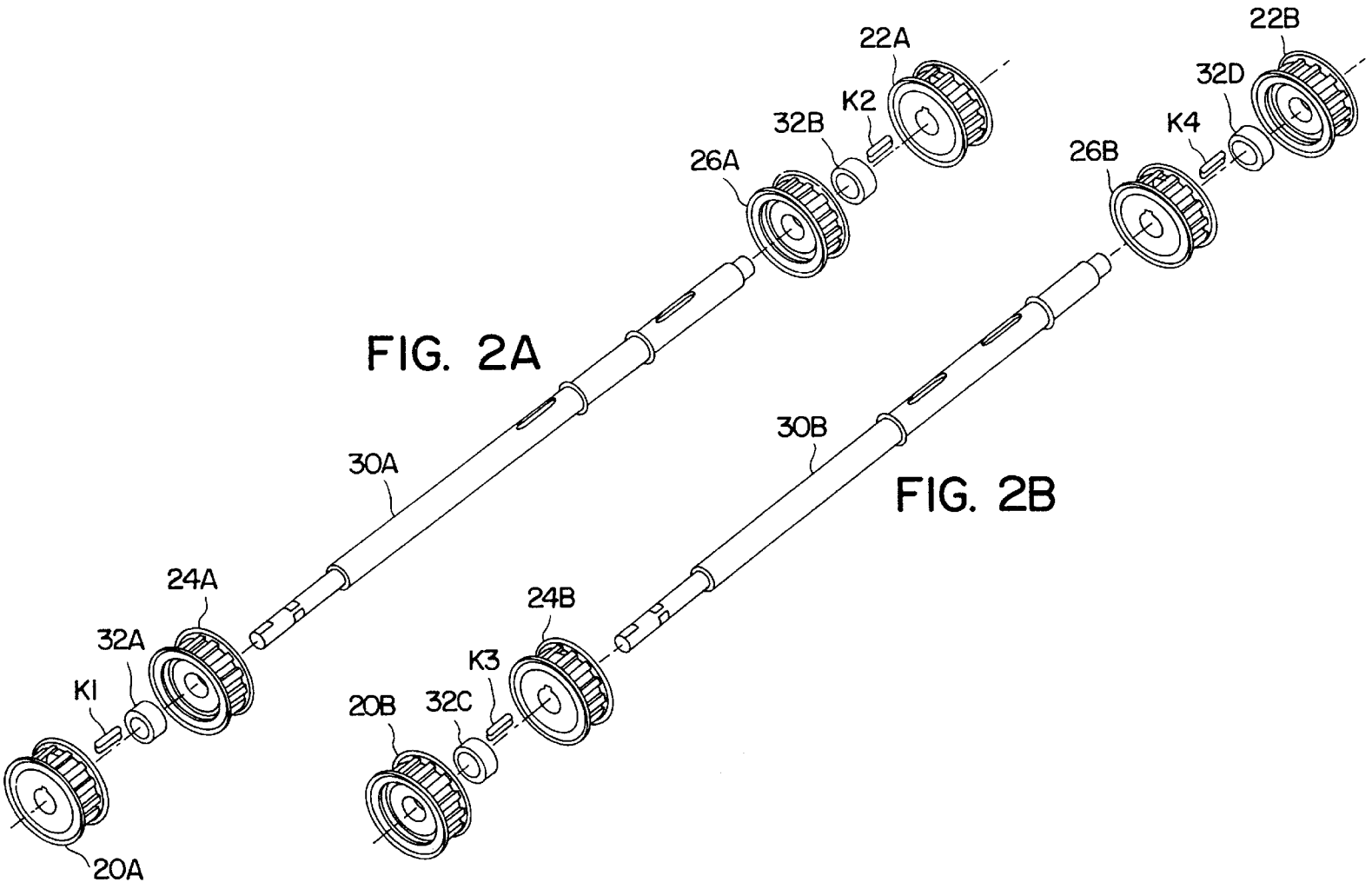
FIG. 2A of the drawings is an exploded perspective view of one shaft and its pulleys attached thereto according to the present invention.
FIG. 2B of the drawings is an exploded perspective view of another shaft and its pulleys attached thereto according to the present invention.

Referring to FIGS. 2A and 2B, and partially to FIGS. 1 and 6, pulleys 20A, 22A, 24A, and 26A are attached to a common shaft 30A while pulleys 20B, 22B, 24B and 26B are attached to a common shaft 30B. As illustrated in FIG. 2A, pulleys 20A and 24A are close and adjacent to one another separated by spacer 32A on one portion of shaft 30A while pulleys 22A and 26A are likewise positioned adjacent and close to one another separated by spacer 32B on another portion of shaft 30A spaced apart from pulleys 20A and 24A. One of pulleys 20A, 24A and one of pulleys 22A, 26A are drive pulleys while the others are idle pulleys. More specifically, the inner pulleys 24A and 26A attached to shaft 30A are attached by bearings so as to be freely rotatable as idle pulleys. The outer pulleys 20A and 22A, however, attached to shaft 30B are attached by keys K1 and K2, respectively,so that pulleys 20A and 22A are drive pulleys.

As illustrated in FIG. 2B, pulleys 20B and 24B are positioned adjacent and close to one another separated by spacer 32C on one portion of shaft 30B while pulleys 22B and 26B are positioned adjacent and close to one another separated by spacer 32D on another portion of shaft 30B spaced apart from pulleys 20B and 24B. As with the pulleys attached to shaft 30A, one of pulleys 20B, 24B and one of pulleys 22B and 26B is a drive pulley while the other is an idle pulley except that the two inner pulleys attached to shaft 30B, pulleys 24B and 26B, are the drive pulleys while the two outer pulleys attached to shaft 30B, pulleys 20B and 22B, are the idle pulleys. More specifically, pulleys 20B and 22B are attached to shaft 30B on bearings so as to be freely rotatable as idle pulleys. Pulleys 24B and 26B, however, are attached to shaft 30B by keys K3 and K4, respectively, so that pulleys 24B and 26B are drive pulleys.

As partially illustrated in FIGS. 1 and 6, shafts 30A and 30B can be operatively extended past the outer pulleys attached thereto and independently driven by drive means comprising motors M1 and M2, respectively. Motors M1 and M2 can be used to independently control rotation of shafts 30A and 30B, respectively, by the operative connection of drive belts 34A and 34B to motors M1 and M2, respectively, and to fixedly attached pulleys 36A and 36B, respectively. Motors M1 and M2 can be step motors or closed-loop servomotors. By the preferred structure of the belt means as described herein, belt means B1 and B2 operate identically and simultaneously by activation of motor M1 while belt means B3 and B4 operate identically and simultaneously by activation of motor M2.

Attached to each belt B1, B2, B3 and B4 are pusher/stop means illustrated in FIG. 1, 6, 8A, 8B, 9A, 9B and 9C in the preferred embodiment as lug members L1, L2, L3 and L4, respectively. Lug members L1, L2, L3 and L4 are adapted for engaging sheet articles processed through collector apparatus 10. Each lug member L1, L2, L3 and L4 is particularly adapted for providing a front stop for sheet articles collected in collector apparatus 10, and alternately for pushing collected sheet articles collector apparatus 10. The alignment of lug members L1, L2, L3, and L4 is for illustration purposes only, and it is to be understood that the relative positions thereof during actual operation and processing of sheet articles through collector apparatus 10 will not be such that lug members L1, L2, L3 and L4 will all be aligned as in FIGS. 1 and 6. Rather, the positions of lug members L1, L2, L3 and L4 will be such that lug members within pairs thereof will be aligned as described further hereinbelow.

Figure 4:
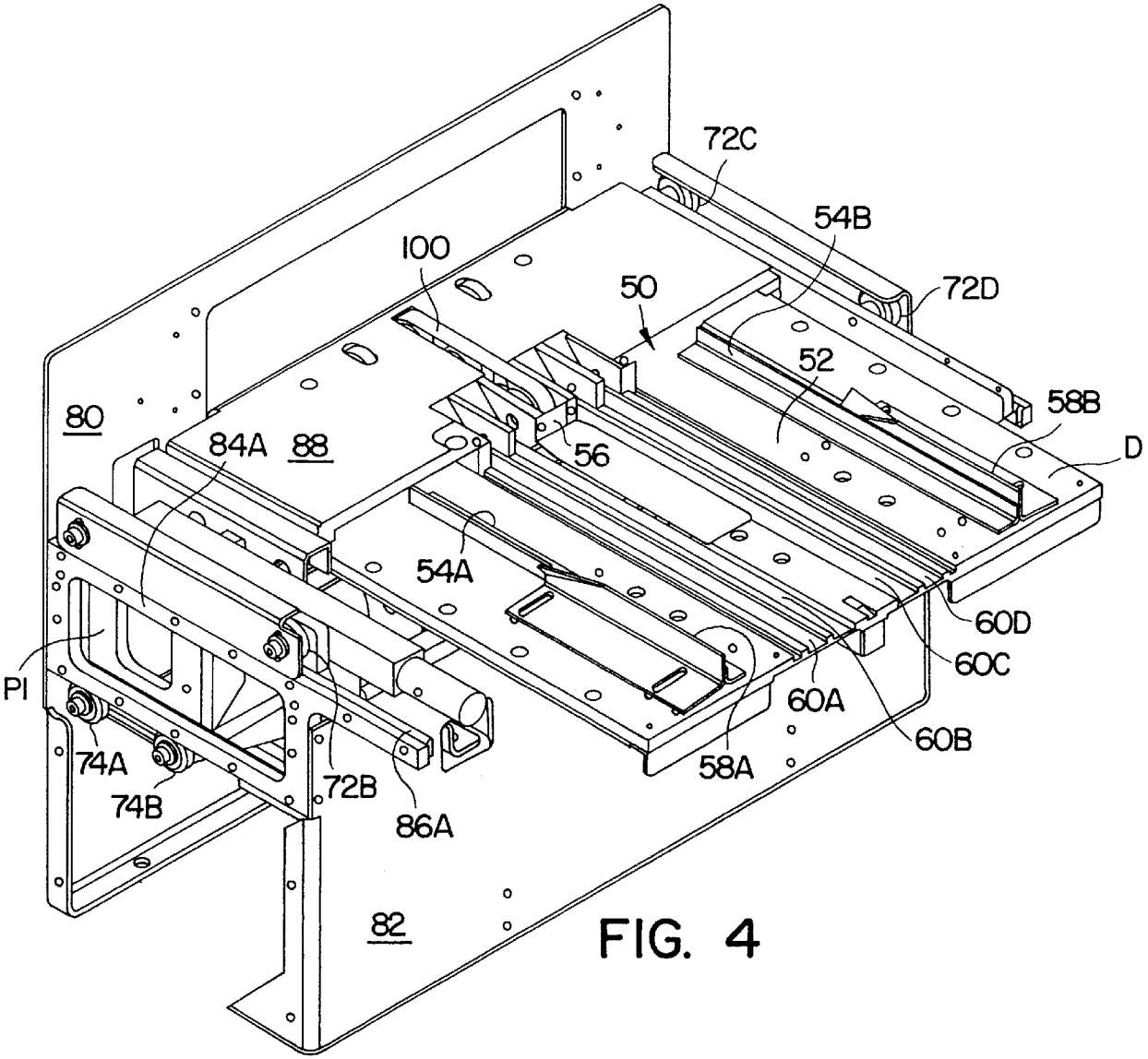
FIG. 4 of the drawings is a perspective view of the stationary frame of this invention and the carrier frame supported thereon with the stage deck on the carrier frame.

Collector apparatus 10 further comprises an adjustable stage generally designated 50 as best shown in FIG. 4 for receiving and supporting one or more sheet articles of various sizes advanced to and collected therein. In the fully assembled form, stage 50 is spacedly positioned below belts B1, B2, B3 and B4 such that sheet articles can be advanced to and in stage 50 below belts B1, B2, B3 and B4, although it can be appreciated and is specifically envisioned according to this invention that stage 50 could be positioned above the belts and define openings through which the lug members could extend to engage and process sheet articles collected in the stage above the belts.

Stage 50 is on a deck D and preferably comprises a bottom flat collector surface 52, side walls 54A and 54B and a rear back stop 56. Side guide plates 58A and 58B are attached to and can extend above side walls 54A and 54B, respectively, and can be used to provide assistance in guiding sheet articles processed through stage 50. A plurality of recessed guide slots 60A, 60B, 60C, and 60D, best shown in FIG. 4, are defined within bottom surface 52 and are adapted for receiving an end portion of lug members L1, L2, L3 and L4, respectively, during operation of collector apparatus 10 such that the lug members can extend past the bottom of the collected sheet articles to facilitate effective stopping and advancement all collected sheet articles.

In accordance with the present invention, sheet articles of various widths and lengths can be collected in stage 50 and subsequently advanced therefrom, and stage 50 is therefore selectively adjustable to accommodate and collect sheet articles of various widths and lengths. Although other dimensions could be provided for, stage 50 is preferably selectively adjustable to receive sheet articles ranging in size from approximately seven (7) inches long and eleven (11) inches wide to eleven (11) inches long and seven (7) inches wide.

In order for stage 50 to accommodate sheet articles of various widths, side walls 54A and 54B are slidably adjustable toward and away from each other, and side guide plates 58A and 58B are likewise slidably movable toward and away from one another since they are attached to side walls 54A and 54B, respectively. In this manner, side walls 54A and 54B and side guide plates 58A and 58B can be selectively adjusted so as to accommodate sheet articles of various widths.

Figure 3:
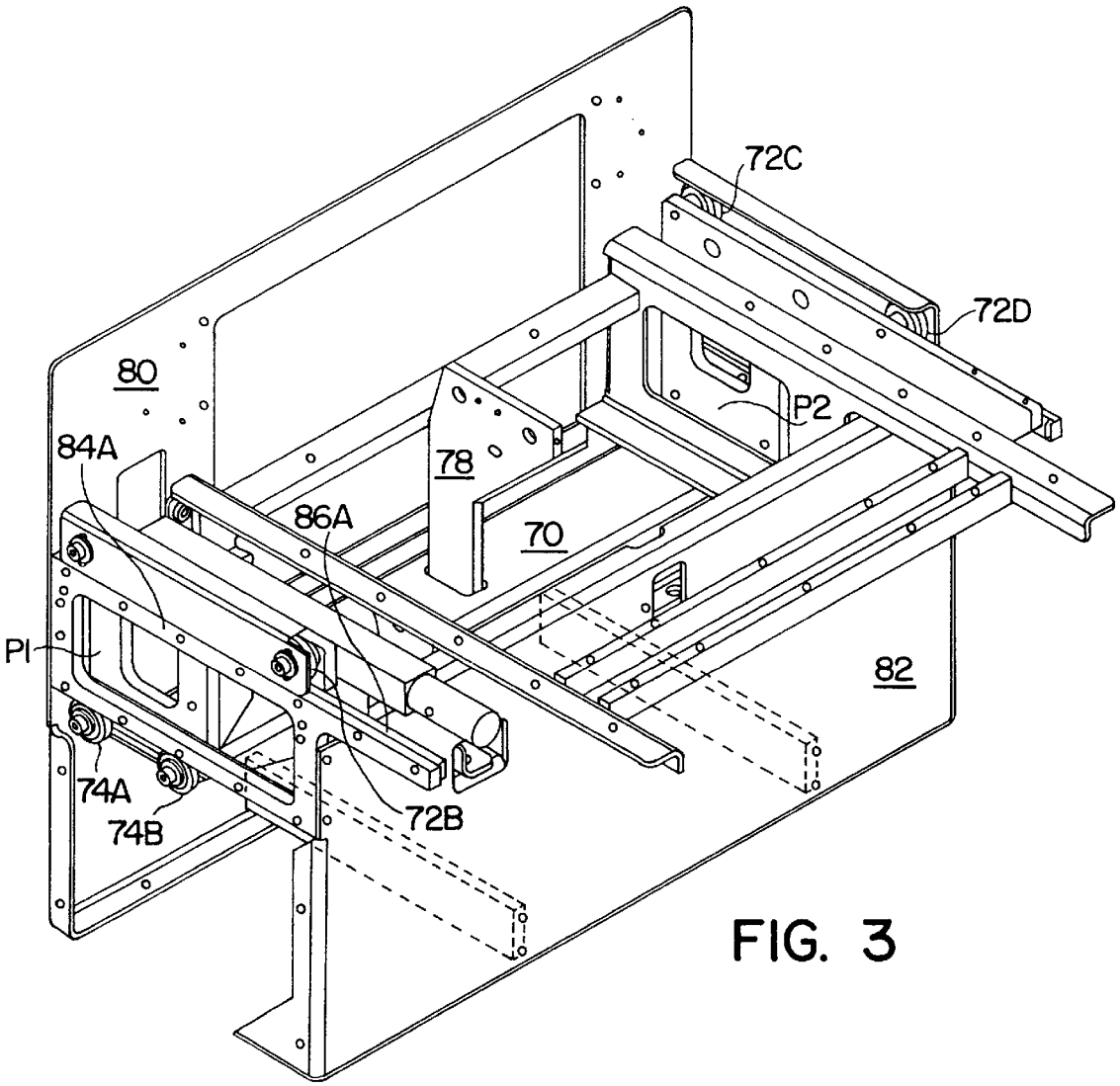
FIG. 3 of the drawings is a perspective view of the collector apparatus of FIG. 1 with upper portions removed therefrom.
Figure 3A:
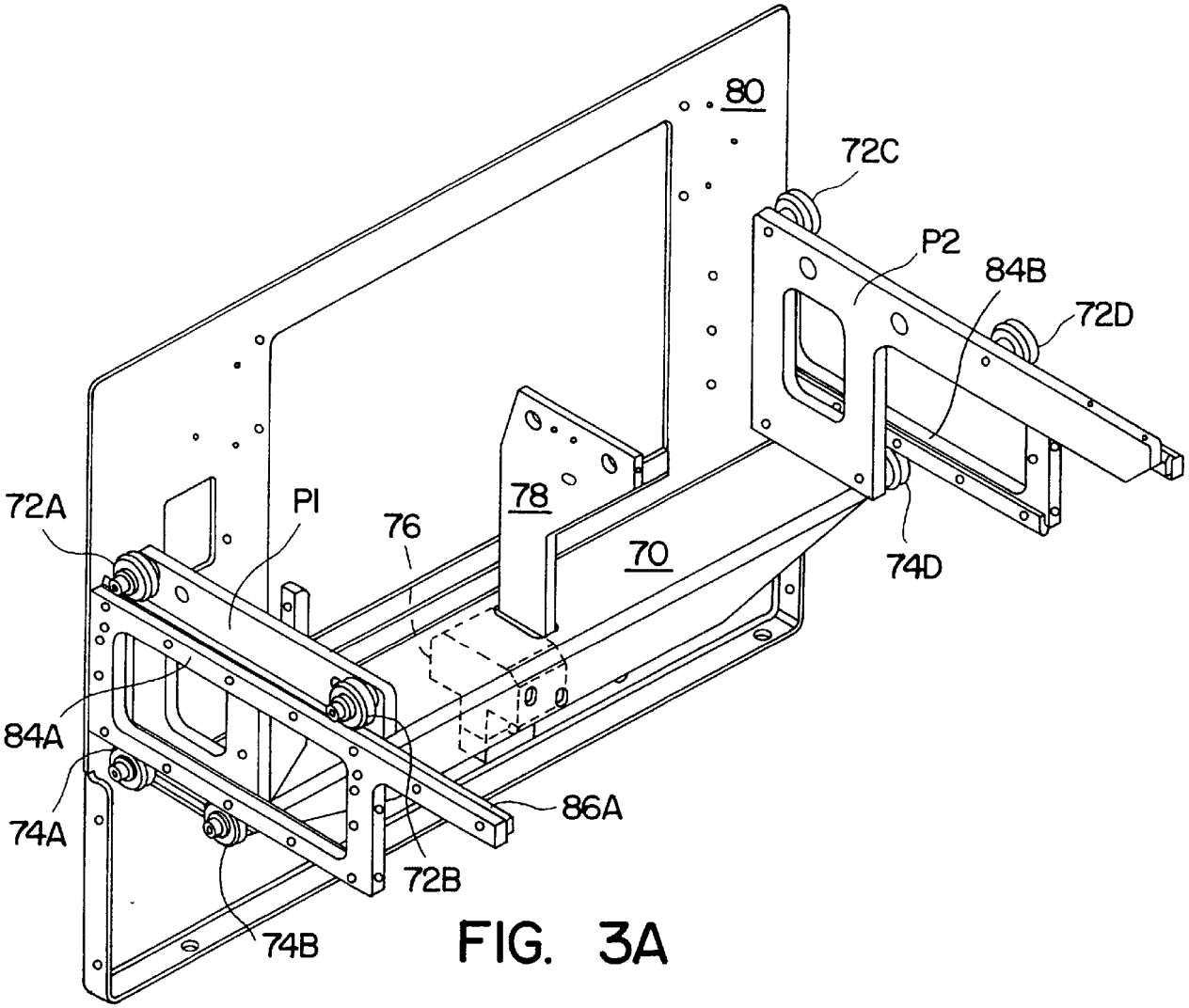
FIG. 3A of the drawings is a perspective view of a rear portion of the stationary frame of the collector apparatus of this invention with a portion of the movable carrier frame supported thereon.

In order for stage 50 to accommodate sheet articles of various lengths, deck D is attached to a movable carrier frame 70 which is best illustrated in FIGS. 3 and 3A of the drawings. Carrier frame 70 includes opposing side plate P1 and P2 and is movably supported on a main support frame which includes back plate 80, front plate 82, and support sections 84A and 84B (FIG. 3A) extending therebetween. More specifically, support sections 84A and 84B define upper tracks, such as upper track 86A of support section 84A, on which upper guide wheels 72A, 72B, and 72C, 72D, respectively, (FIG. 3A) attached to side plates P1 and P2, respectively, can be supported for carrier frame to be slidably movable on support sections 84A and 84B. Carrier frame also includes lower rollers, such as lower rollers 74A, 74B, 74C (not shown) and 74D for fitting against and being guided by lower tracks (not shown) defined in support sections 84A and 84B.

Deck D is therefore slidably connected to the rest of collector apparatus 10 such that deck D is slidably movable toward and away from back plate 80 of collector apparatus 10. As best shown in FIG. 4, an upper shelf 88 can be attached to back plate 80 and/or support sections 84A and 84B, and deck D and stage 50 can be telescopically slidable a predetermined extent beneath and a predetermined extent from beneath upper shelf 88. In this manner, stage 50 can be selectively adjusted to accommodate sheet articles of various lengths.

Figure 3B:
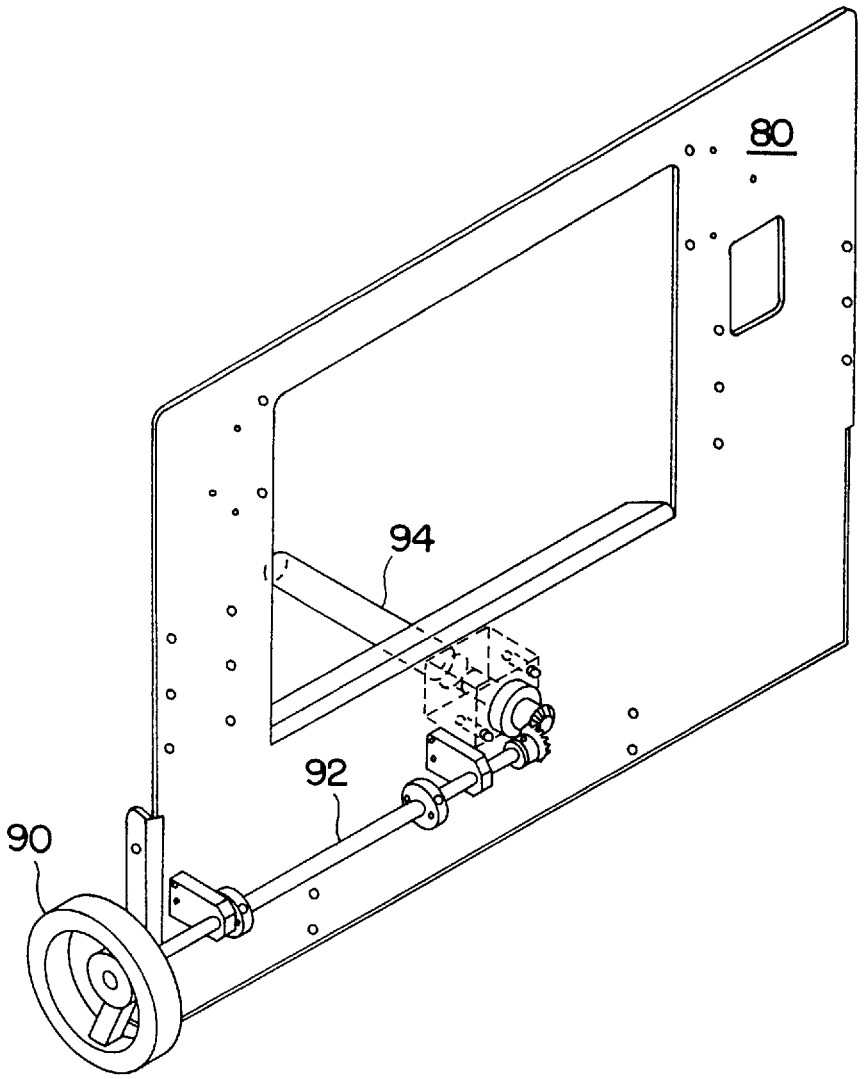
FIG. 3B of the drawings is an isolated rear perspective view of the back plate of the rear portion of the stationary frame according to this invention.

While other suitable means could be utilized for controlling and selecting the extent deck D and stage 50 telescope and slide, collector apparatus 10 includes a handwheel 90 which can be turned to selectively adjust deck D as best illustrated in FIG. 3B. Handwheel 90 connects with a shaft 92 which operatively connects with screw 94 such that turning of handwheel 90 rotates screw 94. Screw 94 is adapted for operative attachment to block 76 (shown in FIG. 3A) which is attached to and underneath carrier frame 70 wherein rotation of screw 94 causes telescopic movement of deck D.

Figure 5:
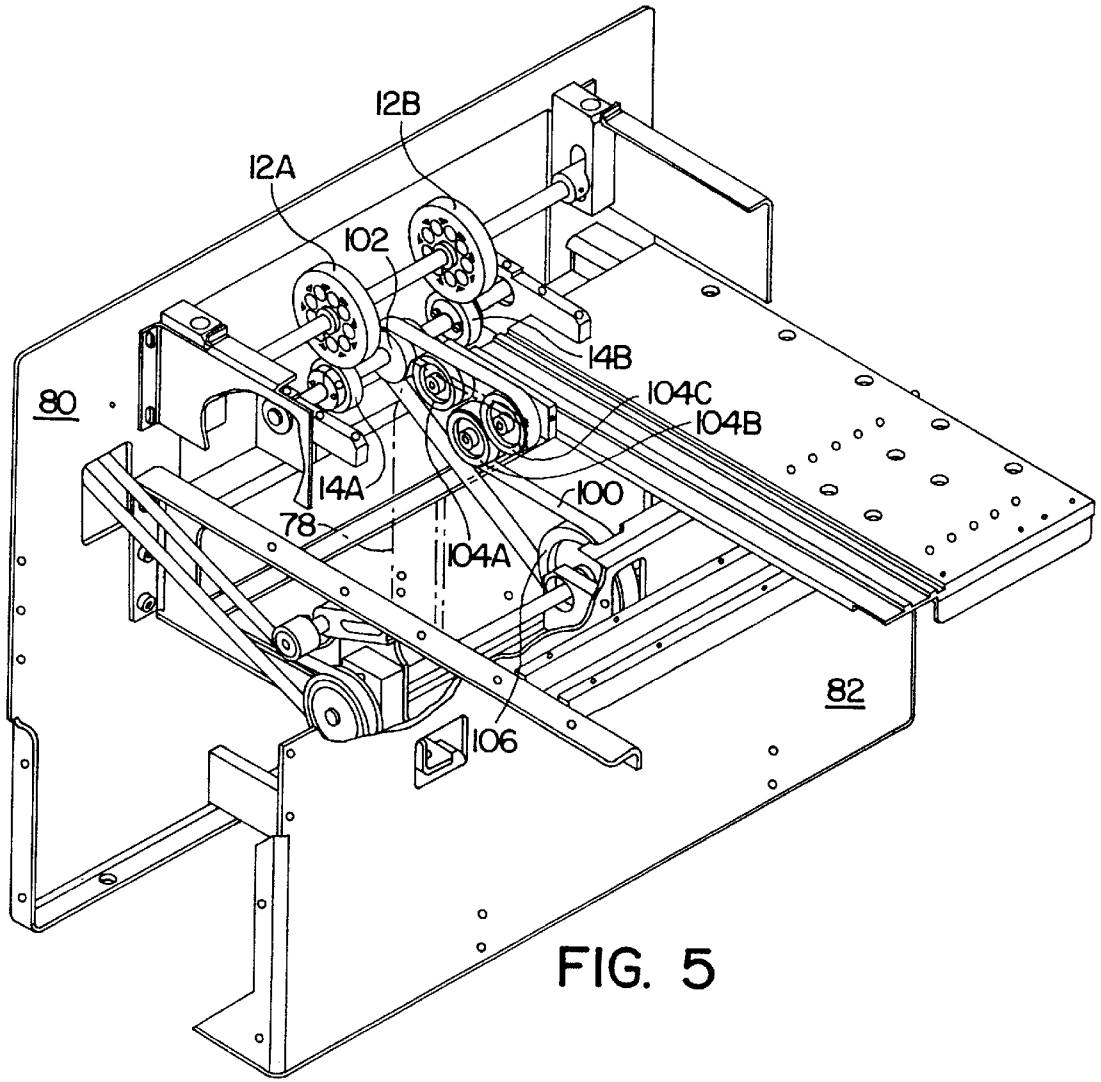
FIG. 5 of the drawings is a perspective view of a portion of the stationary frame and a portion of the carrier frame supported thereon and illustrating a portion of the adjustable center belt system according to this invention.
Figure 7:
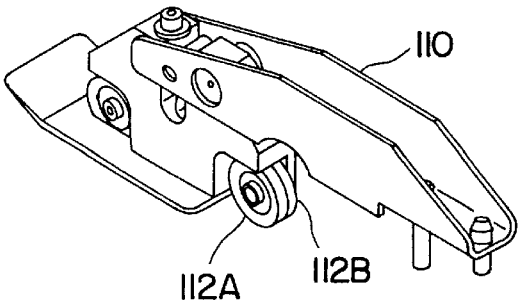
FIG. 7 of the drawings is an isolated perspective view of the center holddown member according to this invention.

Collector apparatus 10 preferably additionally includes at least one extendable and retractable belt means adapted for use in advancing sheet articles fed to collector apparatus 10 to the position in which they will be collected. As best illustrated in FIG. 5 of the drawings, such belt means comprises endless belt means 100 which extends around fixed pulley 102, idle pulleys 104A, 104B and 104C and lower drive pulley 106. Idle pulleys 104A, 104B and 104C are attached to the upper end of deck support 78 of carrier frame 70 wherein they are movable with deck support 78 and whereby the upper portion of belt means 100 between drive pulley 102 and idle pulley 104C extends and retracts as carrier frame 70 slidably moves. Pulley 104B is movably attached to deck support 78 so that belt means 100 can be maintained at a constant tension even during and after extension or retraction. As shown in FIG. 4, a portion of belt means 100 is exposed through an opening defined by upper shelf 88. A holddown member 110, shown in FIGS. 1 and 6 and best shown in FIG. 7, is provided and includes idle rollers 112A and 112B for pressing against belt means 100 for belt means 100 to advance sheet articles to the position for collection.

Figure 6A:
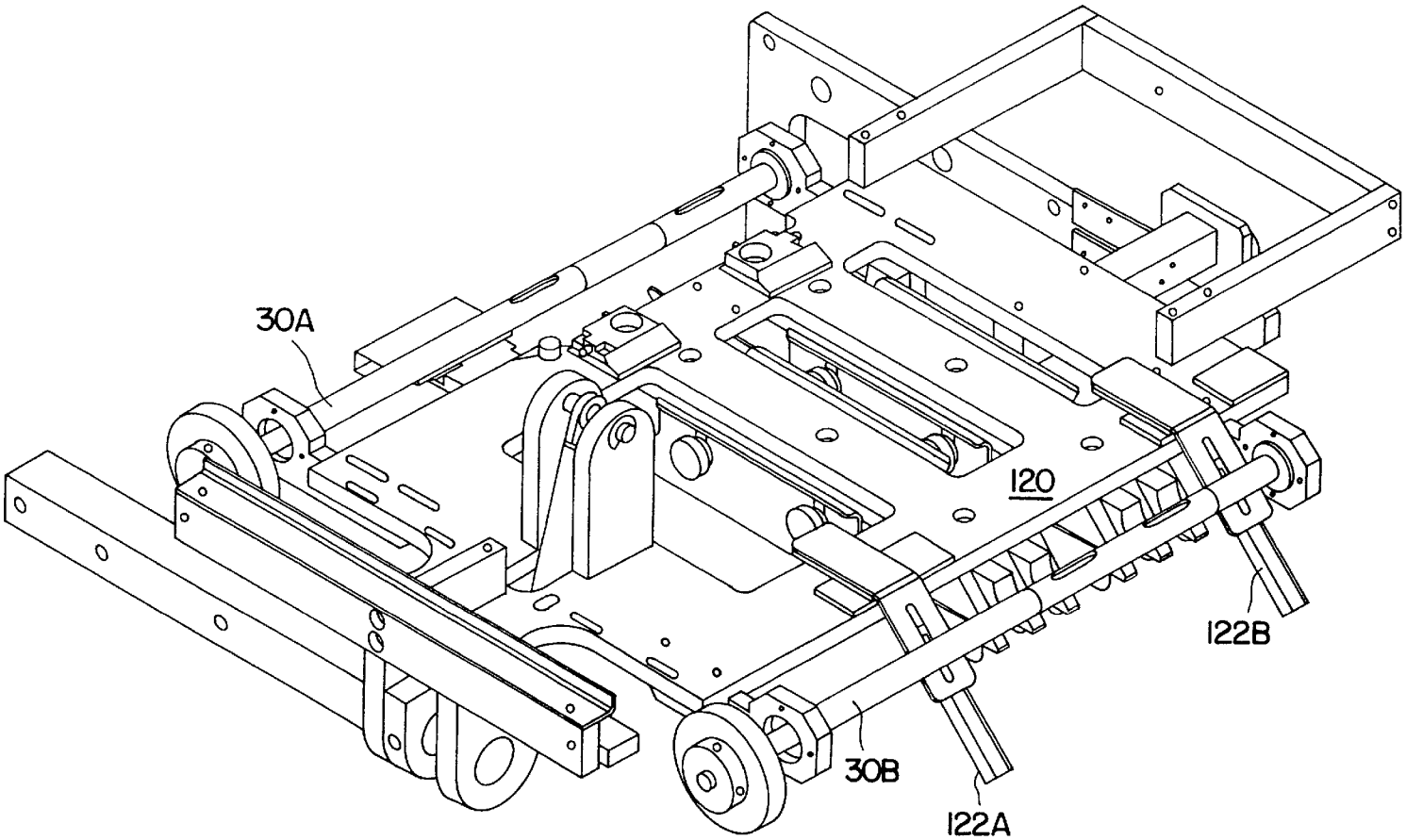
FIG. 6A of the drawings is an isolated perspective view of the intermediate plate of FIG. 6 according to this invention.

Collector apparatus 10 can further include an intermediate plate 120 around which belts the belts can extend without contact as shown in FIGS. 6 and 6A. To assist in maintaining position and alignment of sheet articles exiting collector apparatus 10, deflector brushes such as deflector brushes 122A and 122B can be attached to intermediate plate 120 and positioned so as to suitably contact exiting sheet articles.

According to the method of this invention, sheet articles can be advanced seriatim between transport rollers 12A, 12B and 14A, 14B, respectively, and belt means 100 can then advance the sheet articles in seriatim manner to stage 50 which is in a lower elevational position and allows the sheet articles to be over-accumulated. The sheet articles are stopped from further advancement by one of the pairs of lug members L1, L2 or L3, L4.

As will be apparent to those of skill in the art of high-speed media processing, especially sheet article processing, the individual pairs of lug members of a preferred embodiment of the present invention can be independently controlled and provide the advantage of minimizing lost travel time during material processing. For purposes of illustration, FIG. 8A of the drawings shows one position of lug members L1, L2, L3 and L4 where they are ready for allowing advancement to and collection of sheet articles on bottom surface 52 of stage 50. As shown, lug members L1 and L2 are positioned vertically on the lower or bottom part of belts B1 and B2, respectively, and are proximate the front ends of belts B1 and B2 ready to provide a stop for sheet articles advanced to stage 50. At the same time, lug members L3 and L4 are in a horizontal position on the opposite ends of belts B3 and B4, respectively, out of the way of sheet articles to be advanced to and collected in stage 50.

Figure 8A:
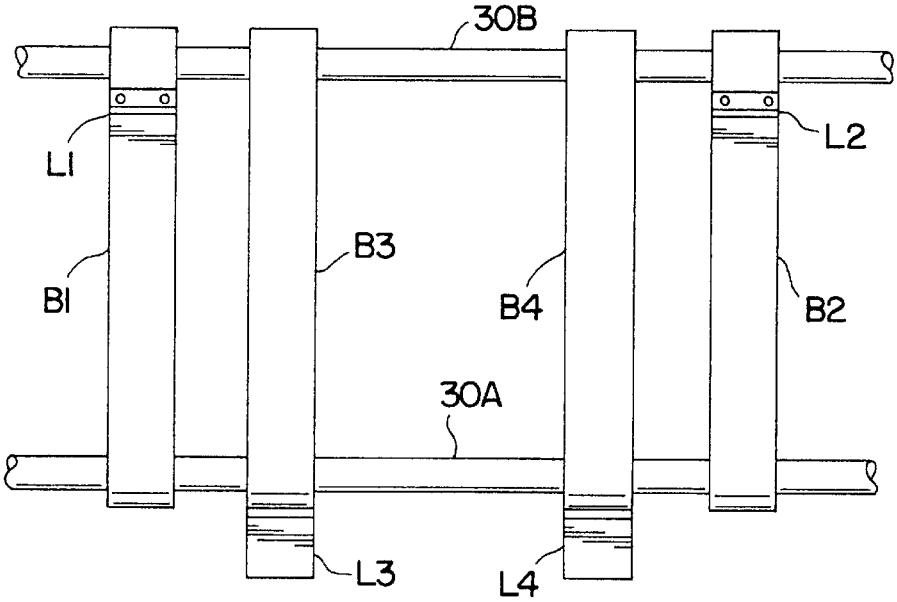
FIG. 8A of the drawings is a bottom plan view of the belt means and shafts illustrating one position of the lug members attached to the belt means according to this invention.
Figure 8B:
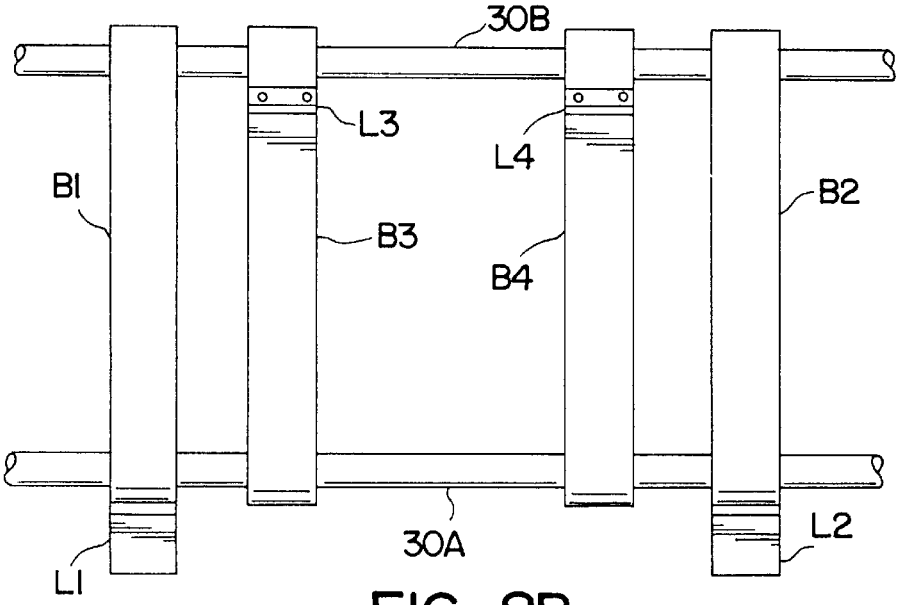
FIG. 8B of the drawings is a bottom plan view of the belt means and shafts illustrating a cycled position of the lug members attached to the belt means according to this invention.

FIG. 8B shows lug members L1, L2, L3 and L4 where they have completely cycled on belts B1, B2, B3 and B4 from their positions shown in FIG. 8A. Now, the pairs of lug members have switched positions on their respective belts as lug members L1 and L2 are now both in a horizontal position on an end of belts B1 and B2, respectively, while lug members L3 and L4 are both vertical on the bottom sides of belts B3 and B4 proximate ends thereof in the front stop position. FIG. 8B therefore illustrates another position where lug members L1, L2, L3 and L4 are in a position ready for sheet articles to be advanced and collected in stage 50.

Figure 9A:
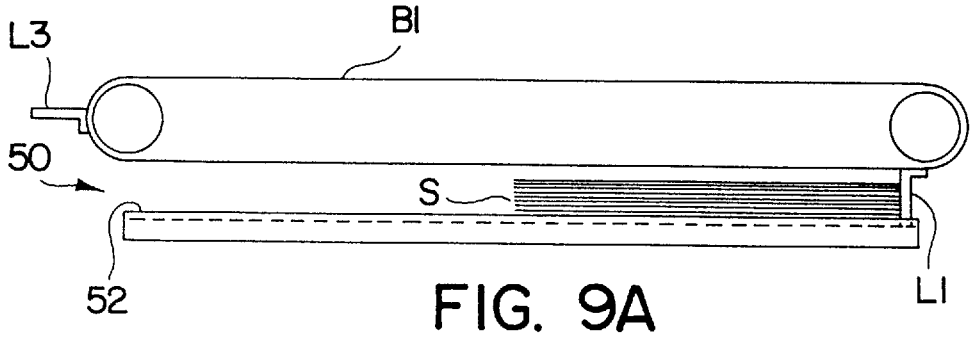
FIGS. 9A, 9B and 9C of the drawings are side schematic illustrations of positions of the lug members according to this invention during various stages of cycling to collect and advance a stack of sheet articles.
Figure 9B:
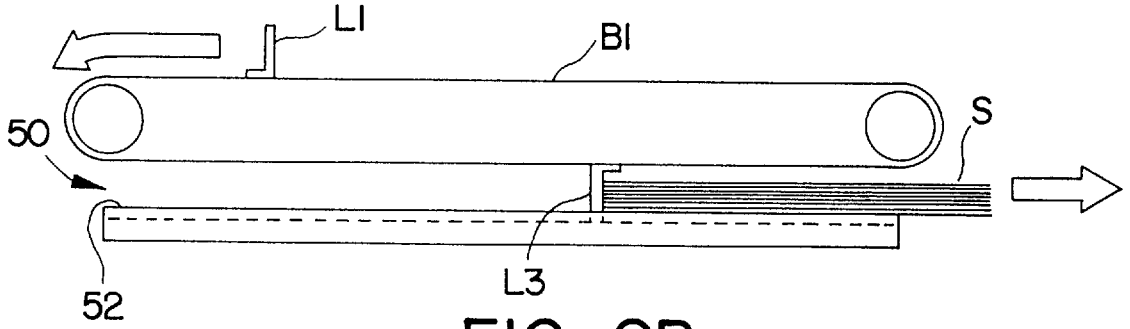
Figure 9C:
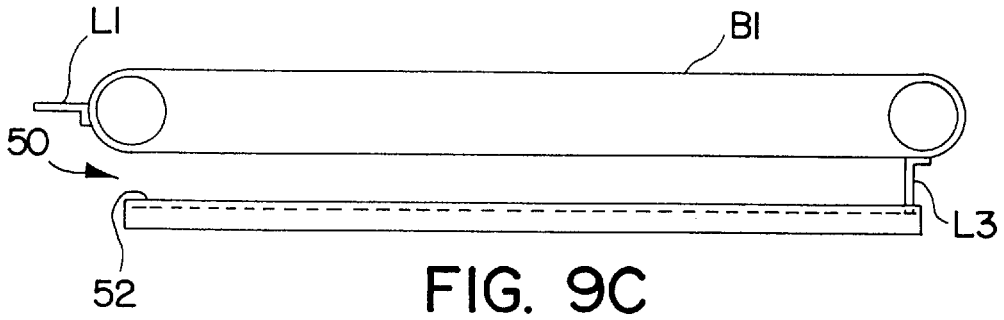

For further illustration, FIGS. 9A, 9B and 9C of the drawings schematically illustrate by side views cycling of collector apparatus 10. As shown in FIG. 9A, a stack S of sheet articles has been collected on bottom surface 52 of stage 50 below the belts as only belt B1 can be seen. Stack S is in front end registration against lug member L1, which minimizes dump cycle time, as it provides a stop preventing further advancement of stack S. A portion of lug member L1 actually extends below bottom surface 52. It can be understood that lug member L2 is hidden by lug member L1 but that lug member L2 would be in the front stop for stack S. Lug member L3 is in the rear ready position where it allows advancement of sheet articles to stage 50. Again it can be understood that lug member L4 is hidden by lug member L3 but that lug member L4 would also be in the rear ready position.

FIG. 9B illustrates a partially cycled position wherein lug member L1 has cycled in the advance direction and around to the top of belt B1 where it is advancing toward the rear. Lug member L3 has cycled down and around belt B3 (not shown) to engage and push stack S from stage 50 in the opposite direction from which the sheet articles forming stack S entered stage 50. An end portion of lug member L3 extends below bottom surface 52.

FIG. 9C illustrates completion of the cycle and shows lug member L1 now in the rear ready position while lug member L3 is now in the front stop position ready for stopping another stack of sheet articles to be collected in stage 50. Lug member L3 has stopped very close to the front end of stage 50 which is advantageous by facilitating complete advancement of stack S from stage 50.

It can therefore be seen that the present invention provides a novel collector apparatus and method, particularly for use in high-speed media processing, for collecting and advancing sheet articles. It can also be seen that the present invention provides a collector apparatus and method for collecting and advancing sheet articles with an ability to collect and advance larger stacks of sheet articles than prior art collector apparatuses and methods. As can be appreciated, the present invention further provides a collector apparatus and method which selectively and adjustably allows for collection and advancement of sheet articles of various dimensions or sizes and which provides for improved handling of processed sheet articles in order to minimize toner smearing on and prevent shingling of processed sheet articles.

It will be understood that various details of the invention may be changed without departing from the scope of the invention. Furthermore, the foregoing description is for the purpose of illustration only, and not for the purpose of limitation as the invention is defined by the following, appended claims.

What is claimed is:

1. A high capacity collector apparatus for collecting and advancing sheet articles of various sizes advanced thereto, said collector apparatus comprising:

(a) a stage for collecting one or more sheet articles;

(b) pusher/stop means for providing a stop for sheet articles collected in said stage and to push collected sheet articles from said stage, said pusher/stop means comprising a plurality of belt means each having attached thereto a lug member for providing a front stop for sheet articles collected in said stage and for alternately moving to a rear ready position and pushing other collected sheet articles from said stage;

(c) drive means for independently driving at least two of said plurality of belt means; and (d) said pusher/stop means being operative such that a first lug member of at least one of said plurality of belt means driveable by said drive means provides a front stop for first sheet articles collected in said stage while a second lug member of at least one other of said plurality of belt means driveable by said drive means remains in a rear ready position for pushing the first collected sheet articles from said stage, and said first lug member being operatively movable from providing a front stop for the first collected sheet articles to cycle to the rear ready position for pushing second sheet articles to be collected from said stage as said second lug member cycles to push the first collected sheet articles from said stage and stops in the front stop position to provide a front stop for the second sheet articles to be collected in said stage; and (e) whereby said first and second lug members can be controllably driven independently such that sheet articles of various widths and lengths can be collected and advanced from said collecting apparatus.

2. The collector apparatus of claim 1 wherein said plurality of belt means are positioned above said stage.

3. The collector apparatus of claim 1 wherein said stage defines one or more recessed guide slots each adapted for receiving a portion of each lug member of each belt means whereby sheet articles can be collected and advanced above said guide slots.

4. The collector apparatus of claim 1 wherein each lug member of each of said plurality of belt means is adapted for maintaining front end registration of sheet articles collected in a stack in said stage when the lug member provides a front stop for sheet articles collected in said stage.

5. The collector apparatus of claim 1 wherein said drive means comprises at least two independently operable motors operatively connected to at least two of said belt means.

6. The collector apparatus of claim 1 including at least a first and second pair of belt means wherein the belt means within each pair are operatively connected such that rotation of one belt means causes simultaneous and identical rotation of the other belt means.

7. The collector apparatus of claim 1 wherein said stage is selectively adjustable in size such that sheet articles of various sizes can be collected in said stage and advanced therefrom.

8. The collector apparatus of claim 7 wherein said stage is selectively adjustable for width and length.

9. A high capacity collector apparatus for collecting and advancing sheet articles of various sizes advanced thereto, said collector apparatus comprising:

(a) a stage for collecting one or more sheet articles advanced thereto, said stage being selectively adjustable for width and length;

(b) pusher/stop means for providing a stop for sheet articles collected in said stage and for pushing collected sheet articles from said stage, said pusher/stop means comprising a first and second pair of belt means positioned above said stage wherein each belt means has a lug member fixedly attached thereto for providing a front stop for first sheet articles collected in said stage and for alternately moving to a rear ready position and pushing other sheet articles from said stage, said belt means within each pair being operatively connected such that one moves simultaneously and identically to the other;

(c) drive means for independently driving said first and second pairs of belt means, said drive means comprising a separate motor operatively connected to each of said first and second pairs of belt means, and said drive means being operable such that the belt means within each pair is driven simultaneously and identically; and (d) whereby said lug members of said first pair of belt means can simultaneously provide a front stop with front end registration for first sheet articles collected in said stage while said lug members of said second pair of belt means remain in the rear ready position for pushing the first collected sheet articles from said stage, and said lug members of said first pair of belt means are operatively movable from providing a front stop to cycle to the rear ready position for pushing other sheet articles to be collected in said stage from said stage as said lug members of said second pair of belt means cycle to push the first collected sheet articles from said stage and stop in a position to provide a front stop for other sheet articles to be collected in said stage.

10. A method of collecting one or more sheet articles and subsequently advancing said collected sheet articles, said method comprising the steps of:

(a) advancing one or more sheet articles to a stage against first pusher/stop means in a front stop position preventing further advancement of said sheet articles in an advance direction whereby said sheet articles are collected in said stage;

(b) selectively operating at least one belt means to which said first pusher/stop means is attached to move said first pusher/stop means from said front stop position to allow further advancement of said collected sheet articles in the advance direction; and (c) simultaneously with or subsequent to the step of paragraph (b), selectively and independently operating at least one other belt means having second pusher/stop means attached thereto to move said second pusher/stop means such that said second pusher/stop means pushes said collected sheet articles from said stage in the advance direction and stops in a position for providing a front stop to other sheet articles to be collected in said stage.

11. The method of claim 10 wherein a plurality of sheet articles are advanced to said stage in seriatim manner and said sheet articles are collected in a stack in said stage.

12. The method of claim 10 wherein front end registration is maintained for sheet articles collected in said stage.

13. The method of claim 10 wherein selectively operating each of said belt means comprises driving separate pulleys around which said belt means operatively extend.

14. The method of claim 13 wherein said step of driving pulleys comprises actuating separate motors, each motor being operatively connected to one of said belt means.

15. The method of claim 10 wherein said stage is below each of said belt means and said sheet articles are collected in a stack below said belt means.

16. The method of claim 10 wherein said first and second pusher/stop means each comprises at least a pair of lug members and each lug member is attached to a separate belt means, and wherein the belt means within each pair move simultaneously and identically in the steps of paragraphs (b) and (c).

17. The method of claim 10 wherein said stage defines one or more recessed guide passages and wherein each of said pusher/stop means extends within said recessed guide passages during pushing of said stack of collected sheet articles from said stage in the advance direction.

18. A method of collecting a stack of sheet articles and subsequently advancing said stack of collected sheet articles, said method comprising the steps of:

(a) advancing sheet articles in seriatim order to a stage against at least one first pair of lug members in a front stop position providing a front stop preventing further advancement of said sheet articles in an advance direction whereby said sheet articles are collected in a first stack maintaining front end registration in said stage;

(b) operating first belt means above said stage and to which said first pair of lug members are attached such that said first pair of lug members move simultaneously and identically from the front stop position to allow further advancement of said collected sheet articles in said advance direction and to a ready position for pushing a second stack of sheet articles to be collected in said stage; and (c) synchronously with the step of paragraph (b), operating second belt means above said stage having at least one second pair of lug members attached thereto such that said second pair of lug members pushes said first stack of collected sheet articles from said stage in the advance direction and stops in the front stop position for providing a front stop for the second stack of sheet articles to be collected in said stage.

19. The method of claim 18 wherein said first and second belt means each comprises a pair of belts driven by separate drive pulleys and wherein operating each belt means comprises identically and simultaneously driving the drive pulleys and belts within each belt means.

20. The method of claim 19 wherein each drive pulley within each belt means is operatively attached to a common shaft and wherein operating each belt means comprises rotating said shaft of each belt means.

* * * * *